US008152192B2

(12) United States Patent
Dougherty

(10) Patent No.: US 8,152,192 B2
(45) **Date of Patent: *Apr. 10, 2012**

(54) ALL TERRAIN ADAPTER FOR A WHEELCHAIR

(75) Inventor: Patrick S. Dougherty, Boise, ID (US)

(73) Assignee: Pat Dougherty, Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/793,254

(22) Filed: Jun. 3, 2010

(65) Prior Publication Data

US 2010/0237586 A1 Sep. 23, 2010

Related U.S. Application Data

(63) Continuation-in-part of application No. 11/820,632, filed on Jun. 19, 2007, now Pat. No. 7,735,847.

(51) Int. Cl.
*A61G 5/10* (2006.01)

(52) U.S. Cl. ..... 280/304.1; 280/767

(58) Field of Classification Search ..... 280/767, 280/7.1, 7.15, 47.17, 47.18, 47.2, 47.25, 280/47.34, 242.1, 250, 250.1, 278, 287, 293, 280/295, 296, 304.1, 647, 763.1, 764.1; 269/228, 269/236, 32; 180/907
See application file for complete search history.

(56) References Cited

U.S. PATENT DOCUMENTS

| | | | | | |
|---|---|---|---|---|---|
| 444,639 | A | * | 1/1891 | O'Neill | 280/277 |
| 974,365 | A | * | 11/1910 | Draper | 280/277 |
| 1,610,921 | A | * | 12/1926 | Borowski et al. | 280/5.24 |
| 1,876,963 | A | * | 9/1932 | Klass | 56/249 |
| 2,596,411 | A | * | 5/1952 | Jordan | 280/276 |
| 2,649,309 | A | | 8/1953 | Deissner | |
| 2,859,975 | A | * | 11/1958 | Weaver et al. | 280/47.11 |
| 3,069,182 | A | * | 12/1962 | Hufford | 280/87.01 |
| 3,485,508 | A | | 12/1969 | Hudnall | |
| 3,485,510 | A | * | 12/1969 | Merlan | 280/250 |
| 3,694,004 | A | * | 9/1972 | Siebers | 280/277 |
| 4,132,423 | A | | 1/1979 | Chant | |
| 4,141,566 | A | | 2/1979 | Benes | |
| 4,190,261 | A | * | 2/1980 | Moutz | 280/87.01 |
| 4,239,248 | A | * | 12/1980 | Ewers | 280/42 |
| 4,316,616 | A | | 2/1982 | Bolvin | |
| 4,323,258 | A | * | 4/1982 | Culpeper | 280/7.12 |
| 4,336,952 | A | * | 6/1982 | Rochman | 280/87.01 |

(Continued)

FOREIGN PATENT DOCUMENTS

DE 19724024 A 10/1998

(Continued)

OTHER PUBLICATIONS

Brochure and picture of Spoke N Motion for MTC Freedom Wheel model wheelchair adapter.

(Continued)

*Primary Examiner* — John R Olszewski
*Assistant Examiner* — Brodie Follman
(74) *Attorney, Agent, or Firm* — Dergosits & Noah LLP

(57) ABSTRACT

An all terrain adapter for a wheelchair that removably clamps onto the foot support of the wheelchair and supports a relatively large diameter, slightly inclined swivelling nose gear wheel at an extended distance from the foot support to stabilize the wheelchair when it is being pushed over soft or uneven surfaces and which swivels around when the wheelchair is moved forward to lift the front wheels of the wheelchair clear of the ground.

16 Claims, 5 Drawing Sheets

U.S. PATENT DOCUMENTS

| | | | | | |
|---|---|---|---|---|---|
| 4,359,231 | A | * | 11/1982 | Mulcahy | 280/87.01 |
| 4,471,972 | A | | 9/1984 | Young | |
| 4,483,548 | A | | 11/1984 | Zirrilo | |
| 4,690,420 | A | * | 9/1987 | Belka | 280/304.1 |
| 4,720,117 | A | | 1/1988 | Hay | |
| 4,789,175 | A | * | 12/1988 | Schramm | 280/304.1 |
| 5,076,390 | A | | 12/1991 | Haskins | |
| 5,116,067 | A | | 5/1992 | Johnson | |
| 5,149,118 | A | | 9/1992 | Oxford | |
| 5,273,304 | A | | 12/1993 | Berkheimer | |
| 5,280,937 | A | | 1/1994 | Needham | |
| 5,312,127 | A | | 5/1994 | Oxford | |
| 5,427,398 | A | | 6/1995 | Weybrecht | |
| 5,494,126 | A | | 2/1996 | Meeker | |
| 5,501,480 | A | | 3/1996 | Ordelman et al. | |
| 5,624,128 | A | * | 4/1997 | Owens | 280/250.1 |
| 5,695,204 | A | | 12/1997 | Ford | |
| 5,860,657 | A | * | 1/1999 | Kroher | 280/11.223 |
| 5,931,244 | A | * | 8/1999 | Renfroe et al. | 180/6.32 |
| 5,983,452 | A | | 11/1999 | McGovern | |
| 6,027,132 | A | | 2/2000 | Robinson et al. | |
| 6,203,053 | B1 | * | 3/2001 | Sohrt et al. | 280/641 |
| 6,485,039 | B1 | * | 11/2002 | Ming-Fu | 280/87.041 |
| 6,517,092 | B2 | * | 2/2003 | Humphrey | 280/87.041 |
| 6,572,130 | B2 | * | 6/2003 | Greene et al. | 280/266 |
| 6,626,446 | B1 | * | 9/2003 | Yosef | 280/47.38 |
| 6,669,222 | B1 | | 12/2003 | Barrett et al. | |
| 6,869,084 | B2 | | 3/2005 | Volk et al. | |
| 7,073,822 | B1 | * | 7/2006 | Renfroe et al. | 280/771 |
| 7,229,090 | B2 | | 6/2007 | Cumbie | |
| 7,377,527 | B2 | * | 5/2008 | Cunningham | 280/47.38 |
| 7,503,195 | B2 | * | 3/2009 | Vegvary | 70/226 |
| 7,549,655 | B2 | * | 6/2009 | Fan | 280/87.041 |
| 7,694,991 | B2 | * | 4/2010 | Mills et al. | 280/304.1 |
| 7,699,325 | B2 | * | 4/2010 | Durbin | 280/47.11 |
| 7,735,847 | B2 | * | 6/2010 | Dougherty | 280/304.1 |
| 2001/0033069 | A1 | * | 10/2001 | Ivers | 280/648 |
| 2002/0089136 | A1 | * | 7/2002 | Gu | 280/87.021 |
| 2004/0075230 | A1 | * | 4/2004 | Lin | 280/87.041 |
| 2004/0108147 | A1 | * | 6/2004 | Ross | 180/13 |
| 2004/0173989 | A1 | * | 9/2004 | Brichet et al. | 280/270 |
| 2005/0230930 | A1 | * | 10/2005 | Chung | 280/87.041 |
| 2006/0000664 | A1 | | 1/2006 | Huang et al. | |
| 2006/0261575 | A1 | * | 11/2006 | Ehrenreich et al. | 280/643 |
| 2007/0018443 | A1 | * | 1/2007 | Wilmot | 280/755 |
| 2007/0096427 | A1 | | 5/2007 | Knaub | |
| 2009/0008902 | A1 | | 1/2009 | Kylstra et al. | |
| 2010/0201089 | A1 | * | 8/2010 | Durbin | 280/47.11 |
| 2010/0237586 | A1 | * | 9/2010 | Dougherty | 280/304.1 |

FOREIGN PATENT DOCUMENTS

| | | | |
|---|---|---|---|
| EP | 184492 | A | 6/1986 |
| FR | 2841462 | A | 1/2004 |

OTHER PUBLICATIONS

EP 184492 A1 Translation from EPO Website.
DE 19724024 A1 Translation from EPO Website.
FR 2841462 A1 Translation from EPO Website.

* cited by examiner

ALL TERRAIN ADAPTER FOR A WHEELCHAIR

CROSS-REFERENCE TO RELATED APPLICATIONS

This is a continuation-in-part application of application Ser. No. 11/820,632, filed Jun. 19, 2007 now U.S. Pat. No. 7,735,847, which is incorporated herein by reference in its entirety.

FIELD OF THE INVENTION

The present invention relates generally to wheelchairs and more particularly to a terrain adapter for wheelchairs.

BACKGROUND OF THE INVENTION

Conventional, user propelled wheelchairs have a seat frame, relatively large diameter rear wheels, typically from 22 inches to 26 inches, which often have a rim that the user can push to rotate the wheels and thus propel the wheelchair, and a pair of front or caster wheels that are considerably smaller in diameter than the rear or driving wheels, typically between 2 to 10 inches and more commonly 2 to 6 inches. These wheelchairs can also be pushed from behind. However, when an attempt is made to propel or manipulate such wheelchairs on rough terrain or soft terrain, where the vehicle's front wheels either encounter obstructions or sink into the terrain then movement and control of the wheelchair becomes extremely difficult and hazardous. The front wheels can unintentionally be directed in other than the desired direction of movement. Pushing a wheelchair on any surface that is not smooth is both tiring and can be enough to upset the balance of the user or pusher and result in stopping or worse, the user falls out of the wheelchair. This is particularly true for terrain such as sand, snow, ice, and mud, which require extreme strength and physical dexterity to safely propel and guide the wheelchair. Such rough terrain is often unavoidable in daily life situations for a disabled person in a wheelchair. While many of these problems can be overcome simply by increasing the diameter of the front wheels, there are substantial disadvantages to doing so. Compared to small diameter front wheels, the large diameter front wheels are more difficult to propel over normal surfaces which are essentially smooth and hard, are difficult to turn, and allow less clearance for feet positioned on foot plates.

There are known, specialized wheelchairs such as three wheeled sport wheelchairs, some of which are discussed further herein, that can help eliminate some of the above described problems in travelling over rough surfaces, however, typically these wheelchairs are expensive, bulky, and not conveniently suited for travel over smooth, everyday terrain, such as in buildings, homes or the like.

There is a need for a simple, easy to use, easy to install and remove, portable, light weight, low cost, safe, attractive, and durable attachment for wheelchairs to safely and easily negotiate difficult terrain. Such a device should improve handling and personal safety for an individual propelling such wheelchairs, occupants of such wheelchairs, and individuals in the vicinity of such wheelchairs. The device should be capable of use on snow, sand, ice, mud and other terrain, and the like, where wheels ordinarily sink into the terrain, and/or otherwise become directed in a direction other than the desired direction of travel of such wheelchairs, and make wheeled transportation otherwise difficult or impossible, and hazardous, and be easy to use. The device should be of simple construction, easy to manufacture, and easily installable as a retrofit on existing wheelchairs or in new installations during construction and fabrication of such wheelchairs, adjustable and installable for different wheel sizes and on different types of wheelchairs.

Different wheels, skids, skis and other adaptations for wheelchairs have heretofore been known, however, none of these adequately satisfies these aforementioned needs:

U.S. Pat. No. 5,116,067 (Johnson) discloses a wheelchair having a support structure that attaches to standard wheelchair wheels for providing mobility and allowing interchangeability of accessories to change the support structure for sporting events, such as water and snow skiing. The wheelchair has a frame and sockets to replace attachable wheels with water and snow skis.

U.S. Pat. No. 4,141,566 (Banes et al) discloses a sled frame for releasable attachment of a wheelchair. The sled frame has a body portion supporting a pair of laterally spaced, horizontally disposed support members which, in turn, are sized to be disposed between the wheels of a wheelchair to support the frame of the wheelchair on the sled. The support members are each provided with a plurality of locking devices which releasably engage the frame of the wheelchair to securely lock the wheelchair to the sled.

U.S. Pat. No. 5,076,390 (Haskins) discloses a wheelchair having a foldable frame with an interlinked system of parallelogram linkages which can be readily collapsed for travel and to provide access to otherwise restricted areas.

U.S. Pat. No. 5,983,452 (McGovern) discloses wheel and skid for replacement of each front wheel of a wheelchair. Each skid has a saucer-shaped base that expands the contact area of each front wheel to prevent it from sinking into the terrain, and/or otherwise become directed in a direction other than the desired direction of travel. The base has a slot, a wheel assembly having a wheel, the slot having the wheel of the wheel assembly protruding therethrough, and a fastener for fastening the wheel assembly to the wheel skid. This device is not intended to be easily installable and removable when rough terrain is encountered. Instead, it is generally permanently kept on the wheelchair which complicates folding the wheelchair and providing foot spacing on the foot support.

U.S. Pat. No. 5,427,398 (Weybrecht) discloses set of wide auxiliary wheels or wheel extensions so that the wheelchair can be much more easily used off road. An anti-tip over wheel can also be attached to the back of the wheelchair. In general, although these modifications can be added or removed to the wheelchair to adapt it to rough terrain, they generally require the assistance of an abled person, or at least they can not be conveniently added or removed by the user of the wheelchair while he or she is seated in it.

U.S. Pat. No. 4,132,423 (Chant) discloses pivoting rocker shaped struts that attach to the front of a wheelchair to enable the small front wheels of the wheelchair to negotiate sidewalk curbs or the like. The struts can be either permanently attached or removably attached. However useful these devices may be for negotiating curbs or similar obstructions, they are of no great help in soft terrain or over surfaces having holes.

U.S. Pat. No. 6,869,084 (Volk) discloses a wheelchair wherein the front wheels have been replaced by skids. This adaptation is not designed to be easily installable and removable.

A recent innovation is a wheelchair adapter denoted model "Magelan MTC" (ModuleToutChemin) by the French company Magelan and marketed in the USA under the trademark "Freedom Wheel" by a Spokes-'n-Motion of Denver, Colo.

This adapter comprises a Y-shaped frame that must first be attached to the front bars of a wheelchair using two grips. A nose gear wheel attached to the front of the frame is thereafter extended downward by the occupant of the wheelchair by turning a hand crank. The diameter of the nose gear wheel is large compared to the diameters of the conventional wheelchair front wheels. As the nose gear wheel is cranked downward, it tilts the wheelchair back and lifts the much smaller front wheels clear of the ground. The relatively large diameter nose gear wheel is able to roll over soft surfaces or uneven surfaces. The device can be quickly attached and detached by the wheelchair occupant, however, it is relatively large and cumbersome and requires horizontally actuated, leftside and rightside clamping devices, thus generally requiring that the wheelchair occupant have the full use of both arms to push the clamping devices closed. Further, the process of lifting the wheelchair front wheels clear of the ground is cumbersome and time consuming.

For the foregoing reasons, there is a need for a simple, easy to use, easy to install and remove, portable, light weight, low cost, safe, attractive, and durable device to facilitate maneuvering of manually propelled wheelchairs on difficult terrain. Such a device should improve handling and personal safety for an individual propelling such wheelchairs, occupants of such wheelchairs, and individuals in the vicinity of such wheelchairs.

The device should be capable of use on snow, sand, ice, mud and other uneven terrain, and the like, where wheels ordinarily sink into the terrain, and/or otherwise become directed in a direction other than the desired direction of travel of such wheelchairs, and make wheeled transportation otherwise difficult or impossible, and hazardous. The device should be of light weight, simple construction, easy and economical to manufacture, easily installable as a retrofit on existing wheelchairs of all sizes and types, and easy and safe to use.

SUMMARY AND OBJECTS OF THE INVENTION

In view of the above-described disadvantages with present systems, it is an object of the embodiments of the present invention to provide an all terrain adapter for a wheelchair.

It is another object of the present invention to provide an adapter for a wheelchair that increases the stability of the wheelchair when traveling over uneven surfaces or soft surfaces.

It is yet another object of the present invention to provide a light weight all terrain adapter for a wheelchair.

It is still another object of the invention to provide an all terrain adapter for a wheelchair that can be easily and safely installed and removed by the occupant of the wheelchair while he or she is seated in the wheelchair and using only one arm.

The above and other objects are achieved by the present invention of an all-terrain adapter for a wheelchair of the type having a seat frame, including a foot support, and large rear wheels and smaller front wheels mounted to the seat frame for allowing the wheelchair to be rolled over a surface. The adapter includes a strut for removable attachment at one end to the foot support, a single nose gear wheel having a diameter that is at least ten inches, a swivel mount for attaching the nose gear wheel to another end of the strut so that the nose gear wheel swivels about an axis that is slightly inclined from the vertical, attachment means for attaching and detaching the one end of the strut to the foot support, and wherein the front wheels of the wheelchair are lifted from the surface and remain suspended above the surface by the action of propelling the wheelchair in the forward direction to cause the nose gear wheel to swivel in a direction that shortens the wheelbase of the wheelchair between the nose gear wheel and the rear wheels.

In the preferred embodiments the mechanism for attaching the one end of the strut to the foot support includes a hand operated clamp.

In one preferred embodiment, the strut follows a first hypothetical, curved line that is offset from the nose gear wheel and the swivel mount is below a second, hypothetical horizontal line that intersects the top of the nose gear wheel when it the adapter is attached to the wheelchair.

Other features and advantages of the present invention will be apparent from the accompanying drawings and from the detailed description that follows.

BRIEF DESCRIPTION OF THE FIGURES

The present invention is illustrated by way of example and not limitation in the figures of the accompanying drawings, in which like references indicate similar elements, and in which.

DESCRIPTION OF THE PREFERRED EMBODIMENTS

The adapter of the present invention includes a frame that easily attaches to the foot support of the wheelchair and raises the front wheels off the ground as the wheelchair is rolled forward. A slightly canted nose gear wheel attached to the frame extends the wheelbase making the chair more stable pushing over rough surfaces and provides a larger wheel in front to roll over surfaces that would normally upset the wheelchair.

Figure 1:
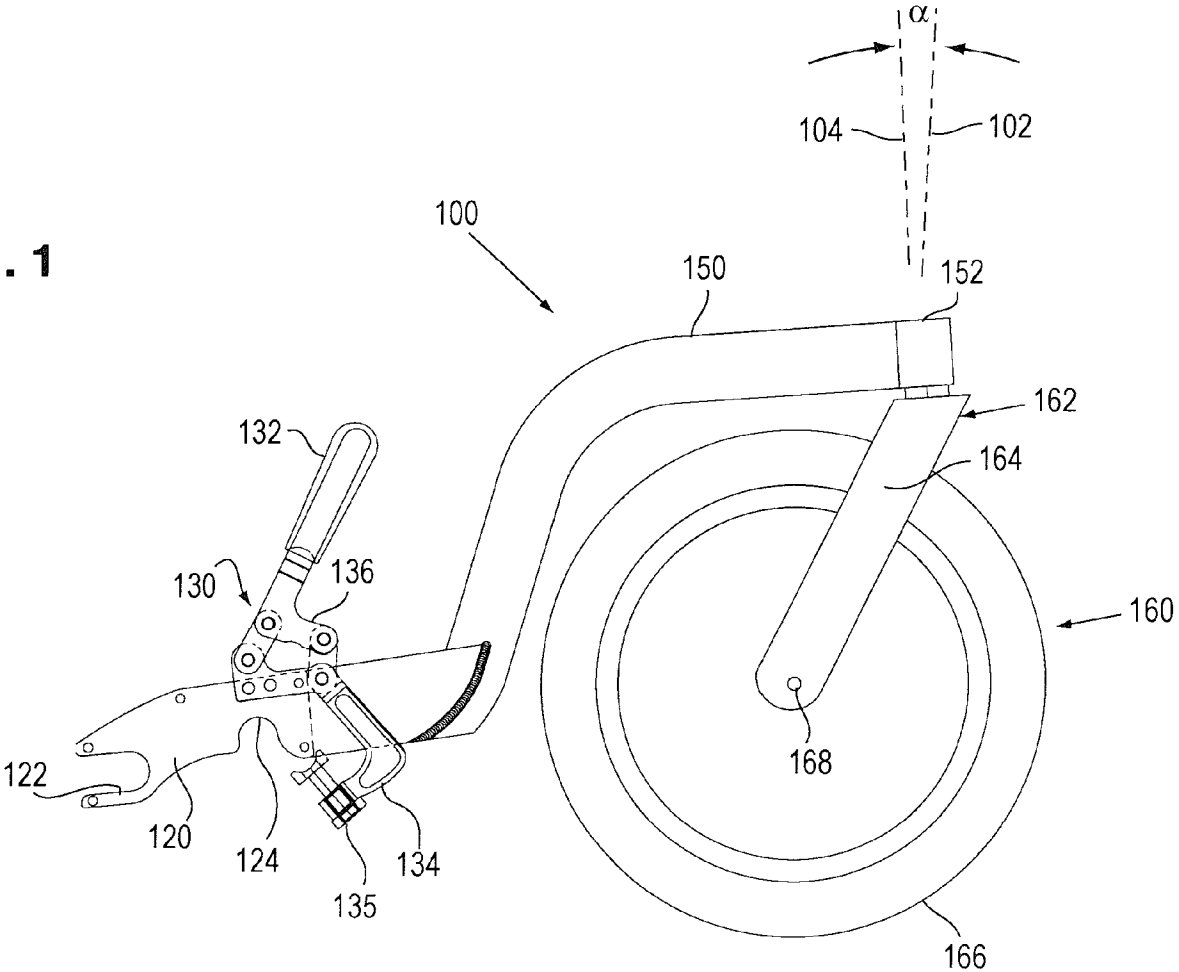
FIG. 1 is a vertical side view of an all terrain adapter for a wheelchair according to a first embodiment of the present invention.
Figure 2:
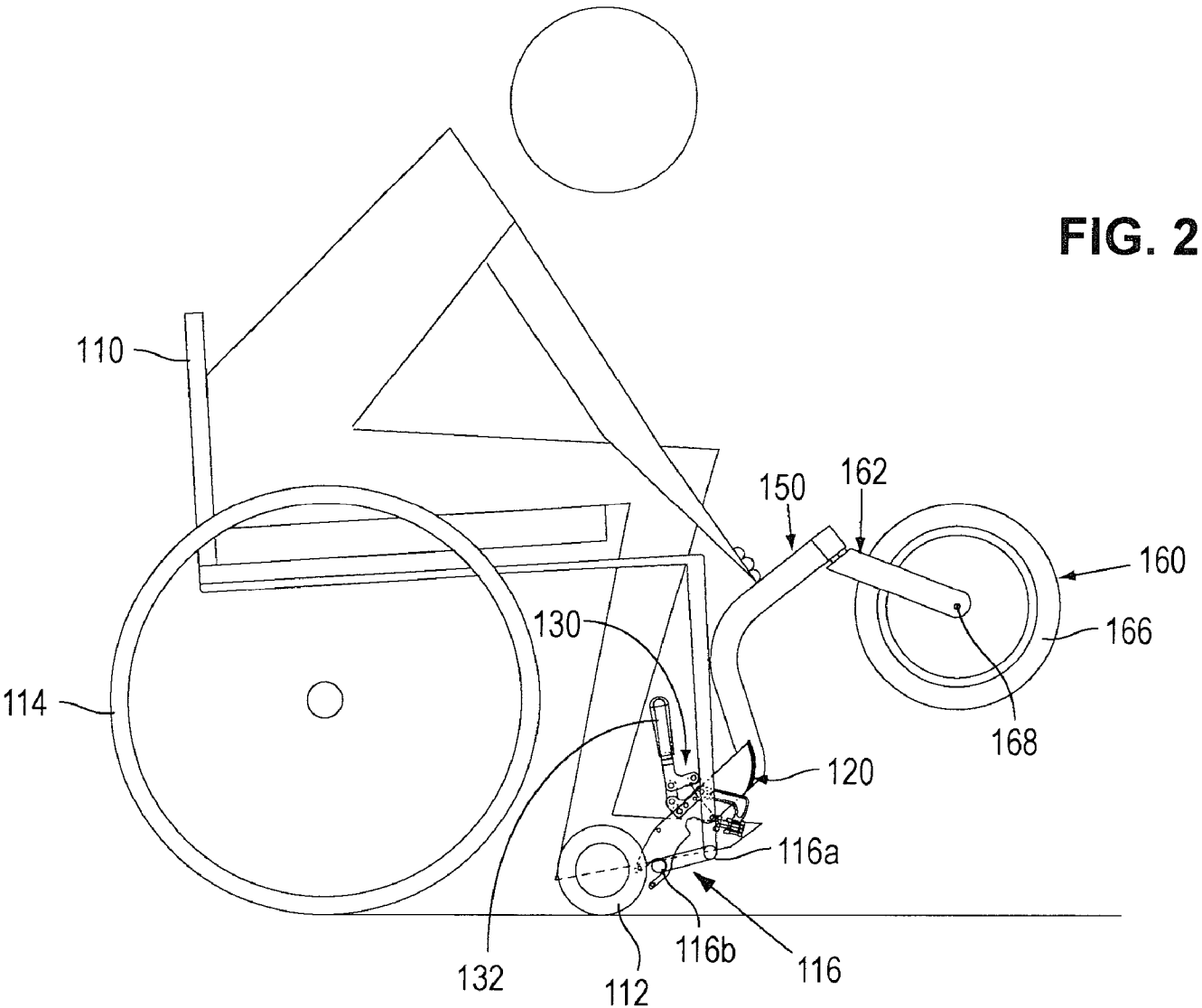
FIGS. 2 and 3 are vertical side views that illustrate the method of attaching the first embodiment of the present invention to a wheelchair.

Referring now to FIGS. 1 and 2, there is shown a first preferred embodiment of the invention comprised of a one piece adapter 100. The adapter 100 attaches to a conventional wheelchair 110 having relatively small front wheels 112, much larger rear wheels 114, and a foot support 116 having a forward bar 116*a* and a rear bar 116*b*. The bars 116*a* and 116*b* are parallel to each other and extend horizontally across the front of the wheelchair frame. The adapter 100 comprises a fixture 120 that has a rectangular cross-section and is provided with a fork opening 122 at one end that engages with the rear bar 116*b* of the wheelchair foot support 116. The fixture 120 also has a downwardly extending notch 124 spaced forward of the fork 122 for engaging with the forward bar 116*a* of the wheelchair foot support 116.

Mounted on the fixture 120 is a hand operated clamp 130 that has a handle 132 and hook 134 and a four bar linkage 136 between the handle 132 and the hook 134. The hook 134 is positioned just beneath the notch 124 and has an adjustable clamping plate 135 that, when the clamp 130 is closed, presses tightly against foot support forward bar 116*a* in the notch 124, locking the fixture 120 onto the wheelchair foot support 116. The clamp 130 can operate other than as shown in the figure, provided that the same clamping action results. In the preferred embodiment the clamp 130 is a pull action, vertical latch clamp manufactured by De-Sta-Co company of Auburn Hills, Mich. By acting in a vertical plane, the wheelchair occupant is better able to use his or her weight in actuating the clamping mechanism, as compared to a horizontal action clamp. Also, the clamp can be actuated with only one arm.

The adapter 100 further comprises an S shaped support or strut 150 that is rigidly attached at one end to the fixture 120 and extends upwardly from it. At the other end of the strut 150 is a swivel mount 152. A nose gear wheel 160 is mounted in a fork 162 for rotation in the swivel mount 152. The swivel mount 152, either due to the angle of attachment of the fixture 120 to the wheelchair 110, the shape of the strut 150, the mounting angle of the swivel mount 152 on the strut 150, or a combination of all of these factors, preferably provides a steering axis 104 that is canted slightly rearwardly from the vertical 102. The angle of this cant defines the caster angle $\alpha$ and is preferably between 5° to 10° from the vertical. A caster angle is defined as the angle that the steering axis makes with the horizontal or vertical, depending on convention. The steering axis 104 is the axis about which the fork 162 pivots. This caster angle could be made to be adjustable by making adjustable the angle of attachment of the fixture 120 to the wheelchair 110, the shape of the strut 150, the mounting angle of the swivel mount 152 on the strut 150, or a combination of all of these.

The nose gear wheel assembly 160 includes the fork 162, that has one end mounted for rotation in the swivel mount 152, and a pair of parallel legs 164 that extend downwardly and slightly rearwardly from the swivel mount 152 (as viewed in FIG. 1) and straddle a wheel 166 that has a relatively large diameter compared to the front wheels 112. In the preferred embodiment, the diameter of the nose gear wheel is between 10" and 16" and is preferably 12". The angle of inclination of the legs 164 is about 27° from the vertical that helps determine a positive trail, which is defined as the horizontal distance from where the steering axis intersects the ground to where the wheel 166 touches the ground. The horizontal trail in the disclosed embodiments is approximately 3". The wheel 166 can include a pneumatic tire and is rotatably mounted about an axle 168 extending between the forks 164.

When the nose gear wheel 160 is traveling in the forward, i.e., the leading direction, the trail of the legs 164 will cause a rotational torque to be exerted on the fork 162 so that it rotates to position itself as shown in FIG. 1 with the wheel axle 168 at its closest point to the wheelchair 110. Taking the distance between the axle of the rear wheels and the axle 168 as the wheelbase of the terrain adapted wheelchair 110, the effect is to minimize this wheelbase. (This is not to be confused with the fact that the terrain adapted wheelchair has a longer wheelbase than the non-adapted conventional wheelchair). When the nose gear wheel 160 is travelling in the opposite direction, i.e., the rearward direction, the position of the fork 162 is rotated 180° from that shown in FIG. 1 so that the axle 168 is moved farther away from the axle of the rear wheels, thereby lengthing the wheelbase of the terrain adapted wheelchair 110. However, because of the caster angle, lengthening the wheelbase has the effect of lowering the foot support 116.

Figure 3:
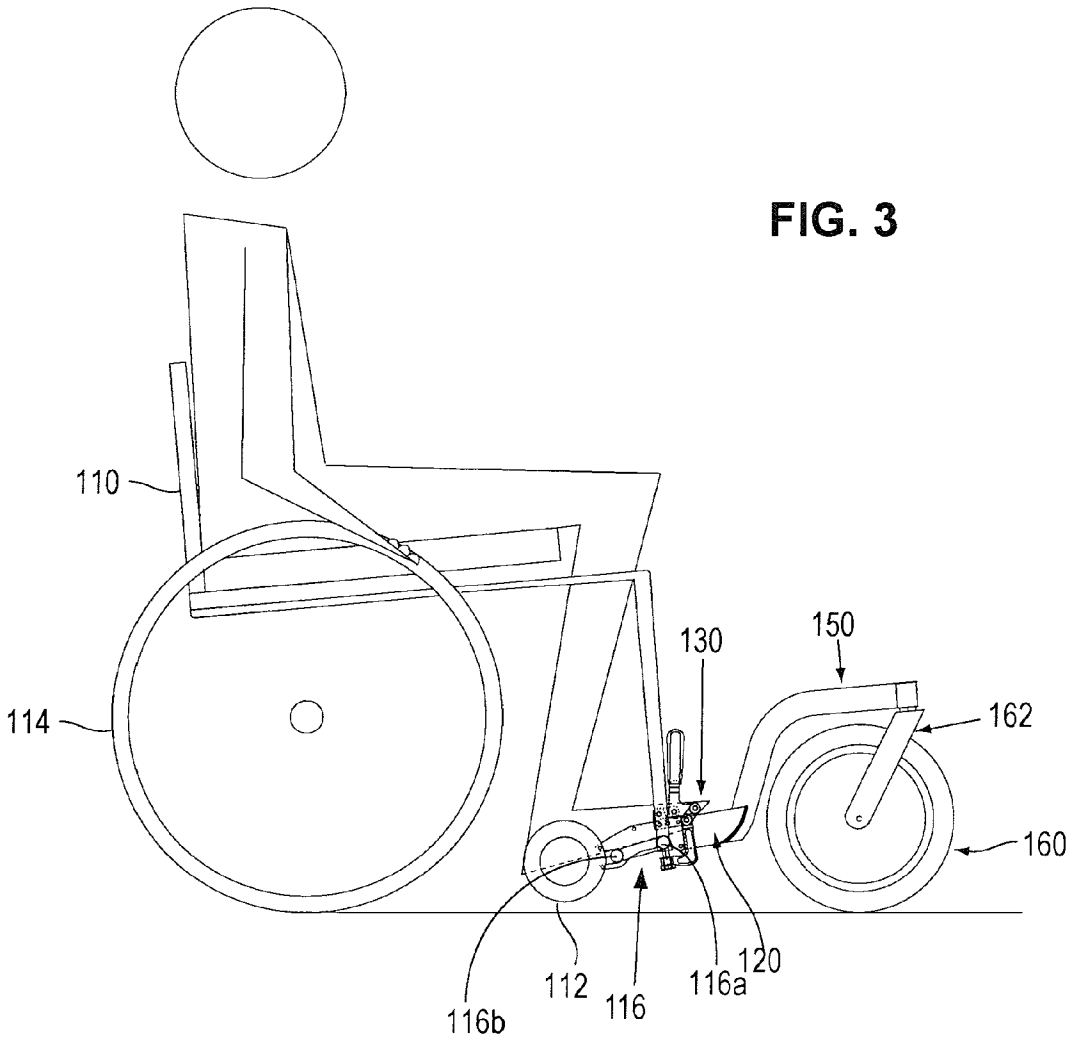

Referring now more particularly to FIGS. 2 and 3, to install the adapter 100, the user slides it in-between his or her feet and engages the parallel bars 116*b* and 116*a* of the wheelchair foot support 116 with the fork 122 and notch 124, respectively, on the fixture 120. The adapter 100 is then lowered to the ground with the nose gear wheel 160 swiveled ahead of the support 150, as shown in FIG. 2. The lever 132 is then pulled to cause the hook 134 and clamping plate 135 to clamp against the front bar 116*a* and both secure the adapter 100 to the wheelchair foot support 116 and to slightly lift some of the weight of the wheelchair 110 from the front wheels 112. The lever 132 is an over-center design and locks into the ready position. When the wheelchair 110 is pushed forward, the nose gear wheel 160 swivels 180° so that it trails behind the front end of the support 150, as shown in FIG. 3. As explained above, this shortens the wheelbase of the terrain adapted wheelchair 110 and thereby lifts the front wheels 112 clear of the ground, placing all of the front weight of the wheelchair 110 on the nose gear wheel 160. To remove the adapter 100, the user simply moves wheelchair 110 in the rearward direction to return the nose gear wheel to the rotational position shown in FIG. 2, thereby dropping the front wheels 112 to the ground, moves the lever 132 back to unclamp the adapter 100 from the front bar 116*a*, thereby returning the front weight of the wheelchair 110 to the front wheels 112, and disconnects the adapter 100 from the wheelchair 110. It is the combination of engaging the lever 132 and then moving the wheelchair 110 in the forward direction to swivel the nose gear wheel 160 that makes lifting the front wheels 112 clear of the ground so relatively effortless for the wheelchair user. Alternatively, as illustrated in FIG. 10, the adapter 100 can be left mounted in an up position stowed and locked between the user's legs by means of a latch or other type of fastening (not shown).

It will be noted that when the wheelchair 110 travels in the rearward direction, the nose gear wheel 160 swivels in such a manner to lower the front wheels 112 to the ground or nearly to the ground, however, this is of no concern because the weight of the wheelchair 110 is still primarily apportioned between the rear wheels 114 and the nose gear wheel 160. The rear wheels 114, because of their relatively large diameters, are easily able to roll over obstacles or soft terrain without upsetting the balance of the wheelchair. That is, during rearward travel there is no tendency for the front wheels 112 to dig in or be stopped by irregularities in the surface.

Figure 4:
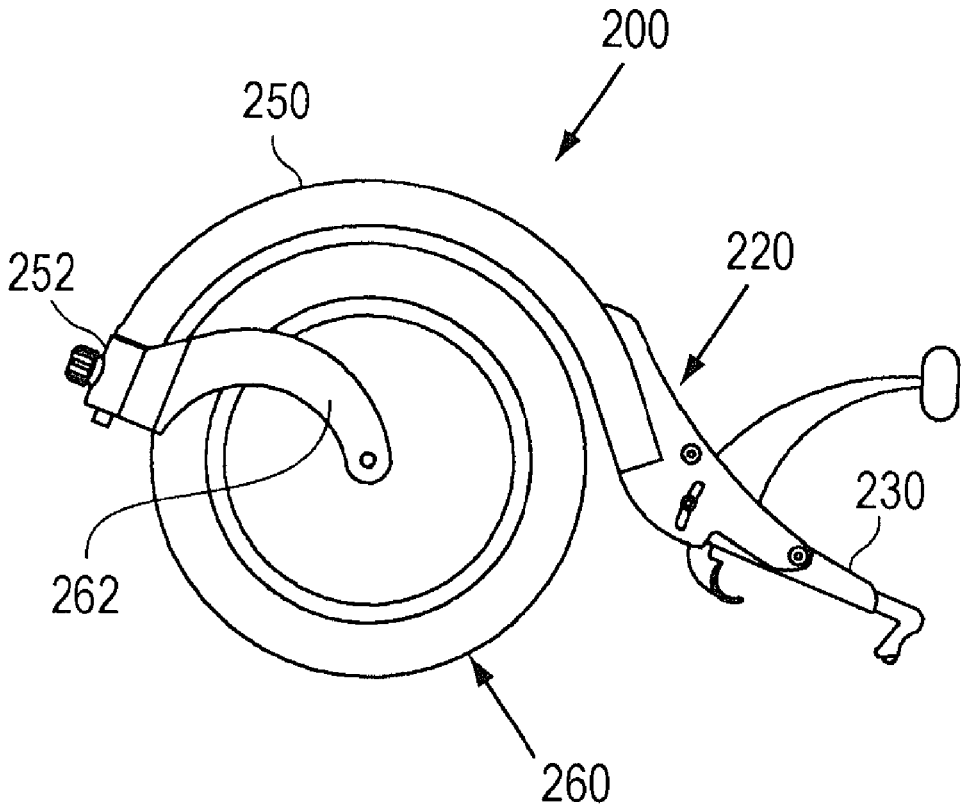
FIG. 4 is vertical side view that illustrate an all terrain wheelchair adapter of a second embodiment of the present invention.
Figure 5B:
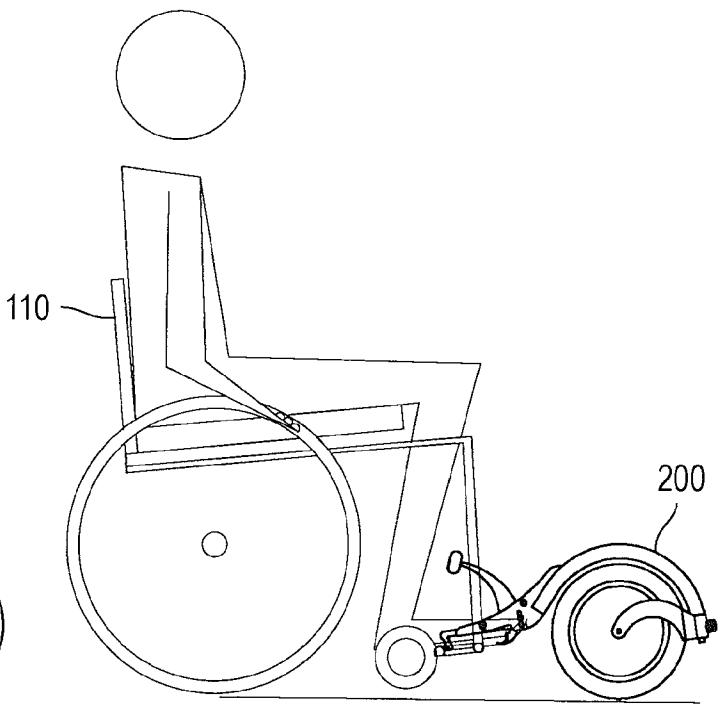
FIGS. 5A and 5B are vertical side views illustrating the all terrain wheelchair adapter of the second embodiment of the present invention before and after being mounted on a wheelchair.
Figure 5A:
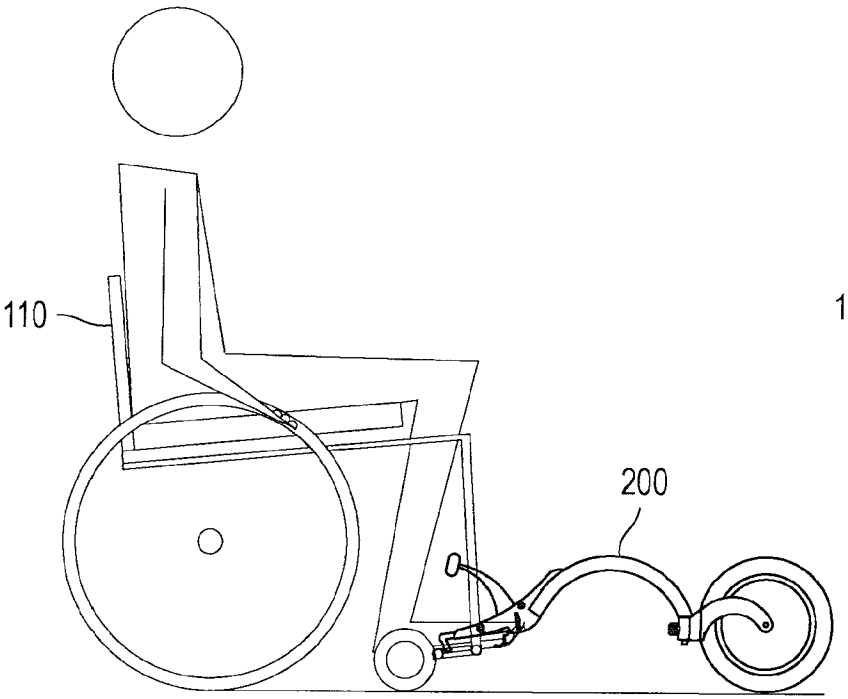

Referring now to FIGS. 4, 5A and 5B, there is shown an adapter 200 according to a second embodiment of the invention. This embodiment is similar in all respects to the first embodiment and attaches and operates in the same manner to lift the front wheels of the wheelchair from the ground surface when the wheel chair is propelled forward after the adapter is attached to the wheelchair. The adapter 200 attaches to the conventional wheelchair 110 having relatively small front wheels 112, much larger rear wheels 114, and a foot support 116 having a forward bar 116*a* and a rear bar 116*b*. The adapter 200 comprises a fixture 220 that engages with the rear bar 116*b* and the forward bar 116*a* of the wheelchair foot support 116 in a manner similar to the adapter 100 of the first embodiment, as shown in FIG. 5A.

Mounted on the fixture 220 is a hand operated clamp 230 that locks the fixture 220 to the wheelchair bars 116*a* and 116*b* in an manner similar to the claim 130 of the first embodiment.

The adapter 200 further comprises a curved support or strut 250 that is rigidly attached at one end to the fixture 220 and extends upwardly from it. At the other end of the strut 250 is a swivel mount 252. A nose gear wheel 260 is mounted on an axle in a fork 262 for rotation about the swivel mount 252. The nose gear wheel 260 can include a pneumatic tire. The swivel mount 252, either due to the angle of attachment of the fixture 220 to the wheelchair 110, the shape of the strut 250, the mounting angle of the swivel mount 252 on the strut 250, or a combination of all of these factors, preferably provides a steering axis that is canted slightly rearwardly from the vertical (with respect to the ground). The angle of this cant defines the caster angle $\alpha$ (as shown in FIG. 1) and is preferably between 5° to 10° from the vertical. A caster angle is defined as the angle that the steering axis makes with the horizontal or vertical, depending on convention. As in the embodiment shown in FIG. 1, the steering axis is the axis about which the fork 262 pivots. This caster angle could be made to be adjustable by making adjustable the angle of attachment of the fixture 220 to the wheelchair 110, the shape of the strut 250, the mounting angle of the swivel mount 252 on the strut 250, or a combination of all of these. After the adapter 200 is attached to the wheelchair 110, it operates functionally in the same manner as the adapter 100 to lift the front wheels 112 of the wheelchair 110 clear of the ground when the wheelchair 110 is moved forward, as shown in FIG. 5B.

The primary differences between the adapters 100 and 200 are in the ergonomic design of the adapter 200. The strut 250 is curved to closely follow the contour of the nose gear wheel 260 so that it takes less space than the strut 150. The location of the swivel mount 252 is lower than the top of the nose gear wheel 260 when the adapter is attached to the wheelchair 110. This and the fact that the strut 250 has a rounded, i.e., round or oval cross-section, makes it less likely that the user will have his or her fingers pinched between the nose gear wheel, the swivel mount, and/or the strut when the adapter 200 is attached and detached from the wheelchair 110. Also, there are no sharp edges to injure the user if the user were to fall on the adapter 200. The legs of the fork 262 are flat and arc-shaped, giving them greater torsional rigidity but with less mass, thus less weight and lower manufacturing costs, than the legs 164 of the fork 162. Lastly, the adapter 200 is more visually appealing than the adapter 100.

Although the present invention has been described with reference to specific exemplary embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. An all-terrain adapter for a wheelchair of the type having a seat frame, including a foot support, and large rear wheels and smaller front wheels mounted to the seat frame for allowing the wheelchair to be rolled over, ground the adapter comprising:

a strut for removable attachment at one end to the foot support;

a single nose gear wheel having a diameter that is at least ten inches;

a swivel mount for attaching the nose gear wheel to another end of the strut so that the nose gear wheel swivels about an axis that is slightly inclined from vertical;

attachment means for attaching and detaching the one end of the strut to the foot support;

wherein the strut is curved along a line that substantially follows the contour of the nose gear wheel; and wherein the front wheels of the wheelchair are lifted from the ground and remain suspended above the ground by the action of propelling the wheelchair in the forward direction to cause the nose gear wheel to swivel in a direction that shortens the wheelbase of the wheelchair between the nose gear wheel and the rear wheels.

2. An all-terrain adapter for a wheelchair as recited in claim 1, wherein the attachment means includes a hand-operated clamp for clamping the one end of the strut to the foot support.

3. An all-terrain adapter for a wheelchair as recited in claim 2, wherein the wheelchair further includes a foot support having a pair of parallel, horizontal bars and the clamp clamps onto at least one of the bars.

4. An all-terrain adapter for a wheelchair as recited in claim 1, wherein the swivel mount is mounted on the strut at a location lower than the highest point of the nose gear wheel.

5. An all-terrain adapter for a wheelchair as recited in claim 1, wherein the swivel mount includes a wheel fork having a pair of canted legs that straddle and rotatably support the nose gear wheel and produce a horizontal trail and wherein the wheel fork rotates about the axis that is inclined from vertical.

6. An all-terrain adapter for a wheelchair as recited in claim 1, wherein the swivel mount includes a wheel fork having a pair of canted legs that straddle and rotatably support the nose gear wheel, each of the legs being flat and being in the shape of an arc.

7. An all-terrain adapter for a wheelchair as recited in claim 1, wherein the strut is tubular and has a rounded cross-section.

8. An all-terrain adapter for a wheelchair as recited in claim 1, wherein the top of the axis about which nose gear wheel swivels is inclined from vertical toward the rear of the wheelchair.

9. An all-terrain adapter for a wheelchair of the type having a frame, and large rear wheels and smaller front wheels mounted to the frame for allowing the wheelchair to be rolled over ground, wherein the adapter comprises:

a fixture clamped to the wheelchair frame;

a strut extending at one end from the fixture toward the forward direction of travel of the wheelchair;

a nose gear wheel assembly including a wheel having a diameter that is at least ten inches and a fork for straddling and rotatably mounting the wheel, the fork having a steering column and a pair of canted legs joined at one end to the steering column so that the wheel has a mechanical trail;

a swivel mount for attaching the steering column to another end of the strut at a caster angle;

wherein the strut is curved along a line that is substantially uniformly offset from the contour of the wheel; and wherein the front wheels of the wheelchair are lifted from the ground and remain suspended above the ground by the action of propelling the wheelchair in the forward direction to cause the nose gear wheel to swivel in a direction that shortens the wheelbase of the wheelchair between the nose gear wheel and the rear wheels.

10. An all-terrain adapter for a wheelchair as recited in claim 9, wherein the fixture includes a hand operated clamp.

11. An all-terrain adapter for a wheelchair as recited in claim 9, wherein the swivel mount is mounted on the strut at an elevation lower than the top of the wheel.

12. An all-terrain adapter for a wheelchair as recited in claim 9, wherein the strut is oval in cross-section.

13. An all-terrain adapter for a wheelchair as recited in claim 9, wherein the strut is circular in cross-section.

14. An all-terrain adapter for a wheelchair as recited in claim 9, wherein the fork legs are flat and arc shaped.

15. An all-terrain adapter for a wheelchair as recited in claim 9, wherein the wheelchair frame includes a foot support having a pair of parallel, horizontal bars and the fixture includes a clamp for clamping the fixture to at least one of the bars.

16. An all-terrain adapter for a wheelchair as recited in claim 9, wherein the caster angle is such that the steering column swivels about an axis the top of which is inclined from vertical toward the rear of the wheelchair.

* * * * *